US008787814B2

(12) United States Patent
Watanabe et al.

(10) Patent No.: US 8,787,814 B2
(45) Date of Patent: Jul. 22, 2014

(54) IMAGE FORMING APPARATUS

(75) Inventors: Yoshitaka Watanabe, Kawasaki (JP); Takeji Horie, Kodaira (JP); Shoji Ito, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 13/217,584

(22) Filed: Aug. 25, 2011

(65) Prior Publication Data

US 2012/0048194 A1 Mar. 1, 2012

(30) Foreign Application Priority Data

Aug. 31, 2010 (JP) ..... 2010-194764

(51) Int. Cl.
*G03G 15/00* (2006.01)
*B65H 1/26* (2006.01)

(52) U.S. Cl.
CPC . *G03G 15/00* (2013.01); *B65H 1/26* (2013.01)
USPC ..... 399/393

(58) Field of Classification Search
USPC ..... 399/393; 271/145
See application file for complete search history.

(56) References Cited

U.S. PATENT DOCUMENTS 5,040,206 A * 8/1991 Tokumasu et al. ..... 379/100.06
5,049,946 A * 9/1991 Harada ..... 399/110
5,651,540 A 7/1997 Watanabe et al.
5,819,149 A 10/1998 Watanabe et al.
2006/0140694 A1* 6/2006 Yano ..... 399/393
2009/0302521 A1* 12/2009 Kondo et al. ..... 271/9.01
2010/0148096 A1* 6/2010 Neushul ..... 250/585

FOREIGN PATENT DOCUMENTS

JP 63101222 A * 5/1988 ..... B65H 1/26
JP 2-225237 9/1990
JP 2692745 12/1997
JP 2000355430 A * 12/2000 ..... B65H 5/36
JP 2003089437 A * 3/2003 ..... B65H 1/26
JP 2004-359364 12/2004
JP 2006-131390 A 5/2006
JP 2006154557 A * 6/2006 ..... G03G 15/00
JP 2006256811 A * 9/2006 ..... B65H 1/26
JP 2007031034 A * 2/2007 ..... B65H 1/26
JP 2007112590 A * 5/2007 ..... B65H 1/26
JP 2007320676 A * 12/2007 ..... B65H 1/26
JP 4093117 6/2008

* cited by examiner

*Primary Examiner* — Nguyen Ha
(74) *Attorney, Agent, or Firm* — Fitzpatrick, Cella, Harper & Scinto

(57) ABSTRACT

A sound insulation member is detachably attached to a bottom of a printer main body to shield a noise in the printer main body. The sound insulation member is detached from the printer main body when an option sheet feeding apparatus is added. When the sound insulation member is not detached from the printer main body in adding the option sheet feeding apparatus, the sound insulation member enters a recess that is provided on an upper surface of the option sheet feeding apparatus.

10 Claims, 13 Drawing Sheets

IMAGE FORMING APPARATUS

BACKGROUND OF THE INVENTION

1. Field of the Invention

The present invention relates to an image forming apparatus, particularly to a configuration that prevents a noise in an image forming apparatus main body from leaking to the outside.

2. Description of the Related Art

Recently, an image forming apparatus, such as a printer and a copying machine, in which a sheet is fed to an image forming portion to form an image becomes widespread. In the image forming apparatus, usually the sheet stored in a sheet cassette is automatically fed to the image forming portion. For example, a sheet feeding apparatus that feeds the sheet is provided in a lower portion of the image forming apparatus main body, and the image forming portion is provided above the sheet feeding apparatus. When an image is formed in the sheet, the sheet fed by the sheet feeding apparatus is conveyed to the image forming portion along a sheet conveying path that is vertically extended.

For an image forming apparatus of a related art, for example, in the case in which the uppermost sheet is separated using a separation pad and fed to the image forming portion, a scratch sound is generated between the separation pad and the sheet when the sheet passes through the separation pad. A scratch sound is also generated when the sheet separated by the separation pad passes through the vertically-extended sheet conveying path. The scratch sounds leak to the outside to become a noise.

In the image forming apparatus of the related art, sometimes the sheet conveying path is jammed with the conveyed sheet. In some pieces of image forming apparatus, a door that can vertically turn with a horizontally-extended turning shaft as a supporting point is provided in a side portion of the image forming apparatus main body, and the door is opened in the sheet jam, thereby opening the sheet conveying path to remove the jammed sheet. For example, Japanese Patent Laid-Open No. 02-225237 discusses the technology.

In the image forming apparatus of the related art in which the door is provided to open the sheet conveying path, it is necessary to provide a gap for the purpose of the opening and closing of the door between the door and the image forming apparatus main body such that the door does not interfere with a frame of the image forming apparatus in the neighborhood of the turning shaft in opening the door. However, when the gap is provided, the noise such as the scratch sound in the image forming apparatus main body leaks from the gap to the outside. Therefore, there is discussed an image forming apparatus in which a sound insulation member such as a sponge and an elastically-deformable thin plate is attached to the door such that the gap between the door and the image forming apparatus main body is closed to prevent the leakage of the noise. For example, Japanese Patent Laid-Open No. 2004-359364 discusses the technology.

When the sound insulation member is provided in the door, the sound insulation member collides with the image forming apparatus main body in opening and closing the door, whereby a position of the sound insulation member is shifted or the sound insulation member drops out. Additionally, the sound insulation member repeatedly collides with the image forming apparatus main body, thereby generating temporal degradation in the sound insulation member. Therefore, conventionally the sound insulation member is attached to a position that is deviated from an opening trajectory of the door between the door and the sheet conveying path.

In the image forming apparatus of the related art, recently a sheet feeding unit is optionally provided below the image forming apparatus main body in order to be able to feed sheets having various sizes and various types and a large number of sheets. Even in the option sheet feeding unit, the door is provided to remove the jammed sheet when the sheet cassette, a sheet feeding roller, a separation portion, or the sheet conveying path is jammed with the sheet.

As described above, the sound insulation member is attached to a position that is deviated from the opening trajectory of the door between the door and the sheet conveying path, for example, the position illustrated in FIG. 5. The following issue is generated in this case. That is, in the configuration in which an option sheet feeding unit 342 is attached below the image forming apparatus main body, unless an end of the sheet conveying path provided above the option sheet feeding unit 342 enters the image forming apparatus main body side, the sheet is caught by a seam of the sheet conveying path, and the sheet cannot be conveyed.

When a sound insulation member 20 is provided at the position illustrated in FIG. 5 in the configuration of the sheet conveying path, the sound insulation member 20 becomes impeditive in jam recovery when a front door 55 of the option sheet feeding unit 342 is opened. Therefore, it is necessary to detach the sound insulation member 20 when the option sheet feeding unit 342 is attached.

However, sometimes a user forgets to detach the sound insulation member. When the option sheet feeding unit is mounted while the sound insulation member is not detached, unfortunately the sound insulation member is nipped between the option sheet feeding unit and the image forming apparatus main body to break the sound insulation member.

SUMMARY OF THE INVENTION

The present invention provides an image forming apparatus in which the sound insulation member is not broken even if an option sheet feeding unit is mounted while the sound insulation member is not detached.

According to an aspect of the invention, an image forming apparatus includes an image forming apparatus main body, an option sheet feeding apparatus that is added to a bottom of the image forming apparatus main body, and a sound insulation member that is detachably attached to the bottom of the image forming apparatus main body so as to shield a noise in the image forming apparatus main body, the sound insulation member is detached when the option sheet feeding apparatus is added, a recess provided on an upper surface of the option sheet feeding apparatus, and the sound insulation member can enter the recess when the option sheet feeding apparatus is added to the image forming apparatus in state that the sound insulation member is not detached from the image forming apparatus main body.

Further features of the present invention will become apparent from the following description of exemplary embodiments with reference to the attached drawings.

DESCRIPTION OF THE EMBODIMENTS

Figure 1:
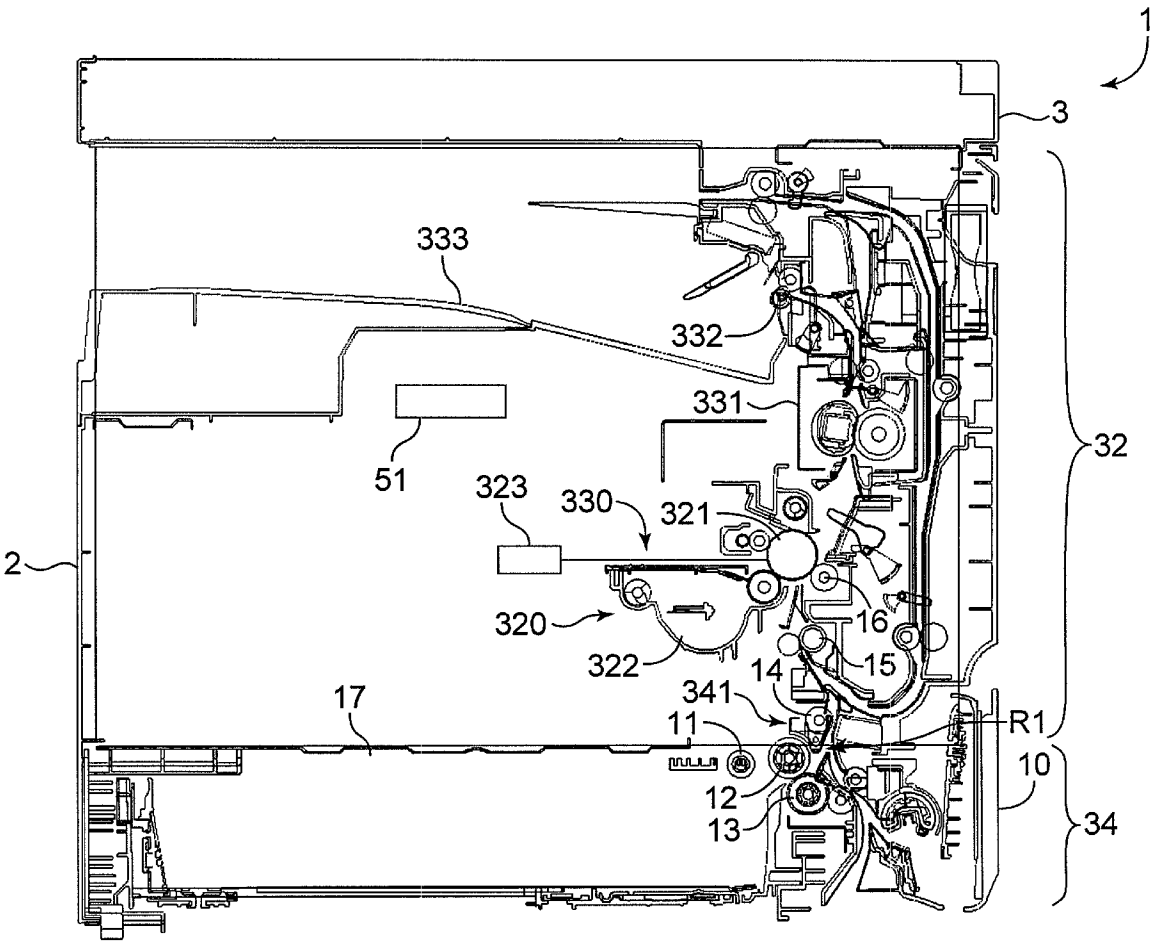
FIG. 1 is a view illustrating a schematic configuration of a printer that is an example of an image forming apparatus according to an embodiment of the invention.

Hereinafter, an exemplary embodiment of the invention will be described in detail with reference to the drawings. FIG. 1 is a view illustrating a schematic configuration of a printer that is an example of an image forming apparatus according to an embodiment of the invention. Referring to FIG. 1, a printer 1 includes a printer main body 2 that is an image forming apparatus main body and an image reading apparatus 3 that is provided above the printer main body 2. A printer portion 32 and a sheet conveying apparatus 34 that conveys a sheet to the printer portion 32 are provided below the image reading apparatus 3.

A printer portion 32 includes a photosensitive drum 321, a process cartridge 320, an image forming portion 330, and a heat fixing device 331. The process cartridge 320 includes a development device 322. The image forming portion 330 includes a laser scanner unit 323. The sheet conveying apparatus 34 includes a sheet feeding and conveying unit 341 and a sheet cassette 17.

The sheet feeding and conveying unit 341 includes a pickup roller 11 that feeds the sheet, a conveying roller 12, a separation roller 13, and a separation portion that separates one by one the sheet delivered by the pickup roller 11. A controlling portion 51 controls an image forming operation and a sheet feed operation of the printer 1.

The image forming operation of the printer 1 having the above-described configuration will be described below. An image of an original set on a platen glass (not illustrated) of the image reading apparatus 3 is read when a start button of an operation portion (not illustrated) provided at a predetermined position on an upper surface of the printer main body 2. The original image read by the image reading apparatus 3 is converted into image data, and the image data is transmitted to the laser scanner unit 323 of the image forming portion 330. Based on the image data from the image reading apparatus 3, the photosensitive drum 321 is irradiated with a laser beam emitted from the laser scanner unit 323 in the image forming portion 330. At this point, in the previously-charged photosensitive drum 321, an electrostatic latent image is formed by irradiating the photosensitive drum 321 with the laser beam. Then the electrostatic latent image is developed by the development device 322 to form a toner image on the photosensitive drum 321.

On the other hand, when the controlling portion 51 outputs a sheet feed signal to the sheet feeding and conveying unit 341, the pickup roller 11 rotates by receiving power from a motor (not illustrated), and the pickup roller performs an operation to deliver the sheet stored in the sheet cassette 17. The sheet delivered by the pickup roller 11 is conveyed to a registration roller 15 by a relay roller 14 after separated one by one by the separation portion, and skew feeding of the sheet is corrected by the registration roller 15. Then the sheet is delivered to a transfer portion, which includes the photosensitive drum 321 and a transfer roller 16, at the timing a leading end of the toner image formed on the photosensitive drum 321 is matched with a leading end of the sheet by the registration roller 15.

The toner image is transferred to the sheet delivered to the transfer portion, and the heat fixing device 331 performs heating and pressurization to permanently fix the toner image to the sheet. The sheet to which the toner image is fixed is discharged to a discharge tray 333 by a first discharge roller 332.

In FIG. 1, a door 10 is provided on a side surface of the printer main body 2 while being able to vertically turn about a horizontal turning shaft. When a sheet conveying path R1 provided in the sheet conveying apparatus 34 is jammed with the sheet delivered from the sheet feeding and conveying unit 341, the door 10 is vertically turned and opened to take out the jammed sheet.

Figure 2:
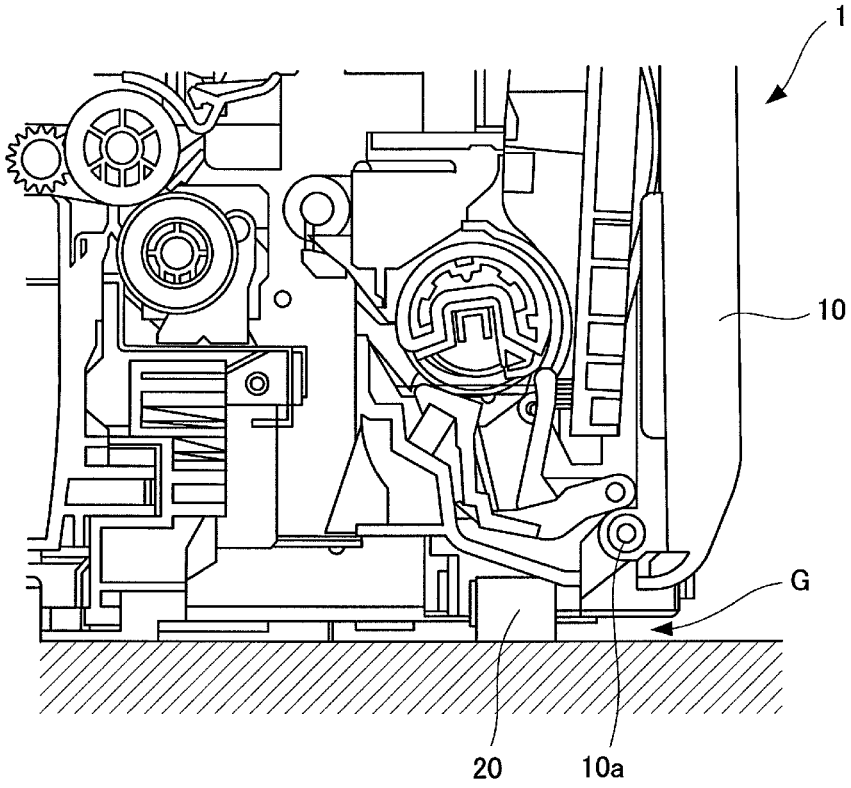
FIG. 2 is a view illustrating a lower configuration of the printer.

When the door 10 is opened about a turning shaft 10*a* illustrated in FIG. 2, it is necessary to provide a gap G on a bottom surface of the printer main body 2 such that the turning door 10 does not interfere with a frame of the printer main body 2. However, when the gap G is provided, a noise such as a scratch sound in the printer main body (in the image forming apparatus main body) leaks to the outside from the gap G. Therefore, the gap G is closed by the sound insulation member 20 such as a sponge and an elastically deformable thin plate such that the noise does not leak to the outside. FIG. 2 illustrates the state in which the printer main body 2 is placed on a mounting surface of a desk and the like. At this point, while the sound insulation member 20 is deformed between the printer main body 2 and the mounting surface, the gap G is shielded by the sound insulation member 20 to prevent the noise in the printer main body from leaking to the outside.

Figure 3:
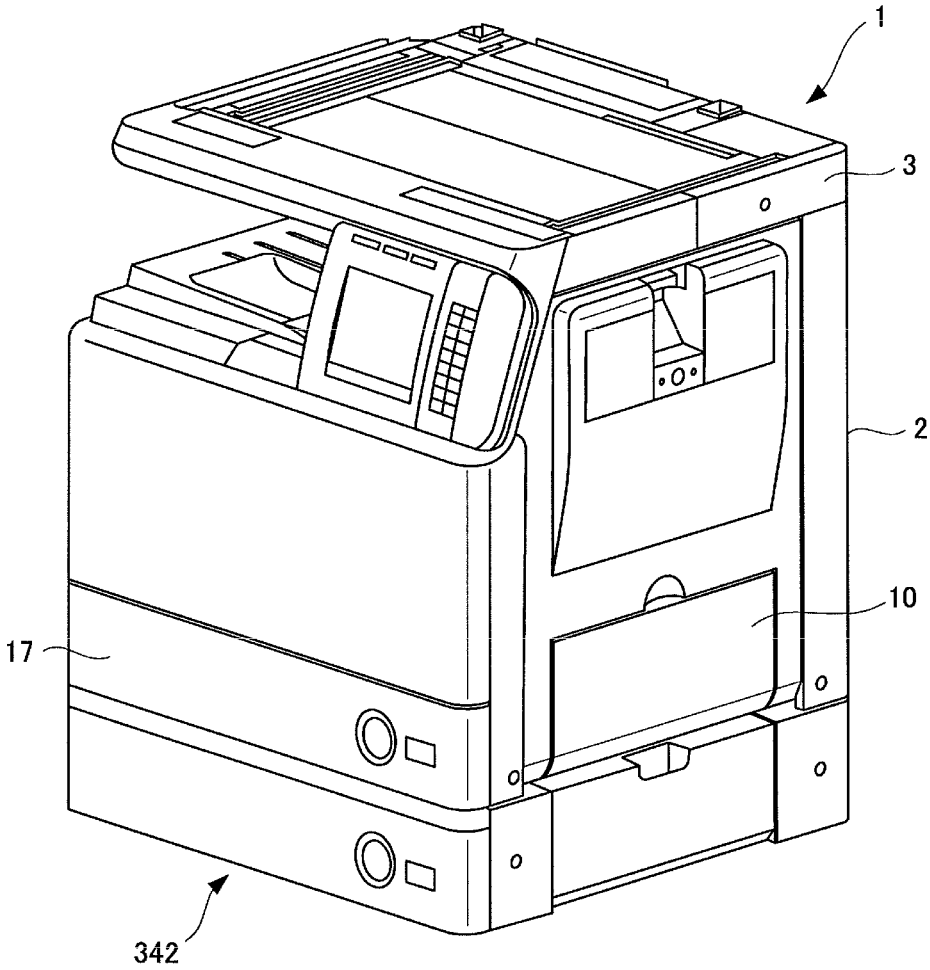
FIG. 3 is a perspective view illustrating a state in which an option unit is added to the printer.

On the other hand, in the printer 1, the sheet feeding and conveying unit 342 is added as an option to a bottom of the printer main body 2 as illustrated in FIG. 3. At this point, the sheet feeding and conveying unit 341 of the sheet conveying apparatus 34 acts as a structure that supports the printer portion 32 from below. A sheet feeding and conveying unit (hereinafter referred to as an option unit) 342 that is the option sheet feeding apparatus can be connected to the sheet feeding and conveying unit 341 from below.

Figure 4:
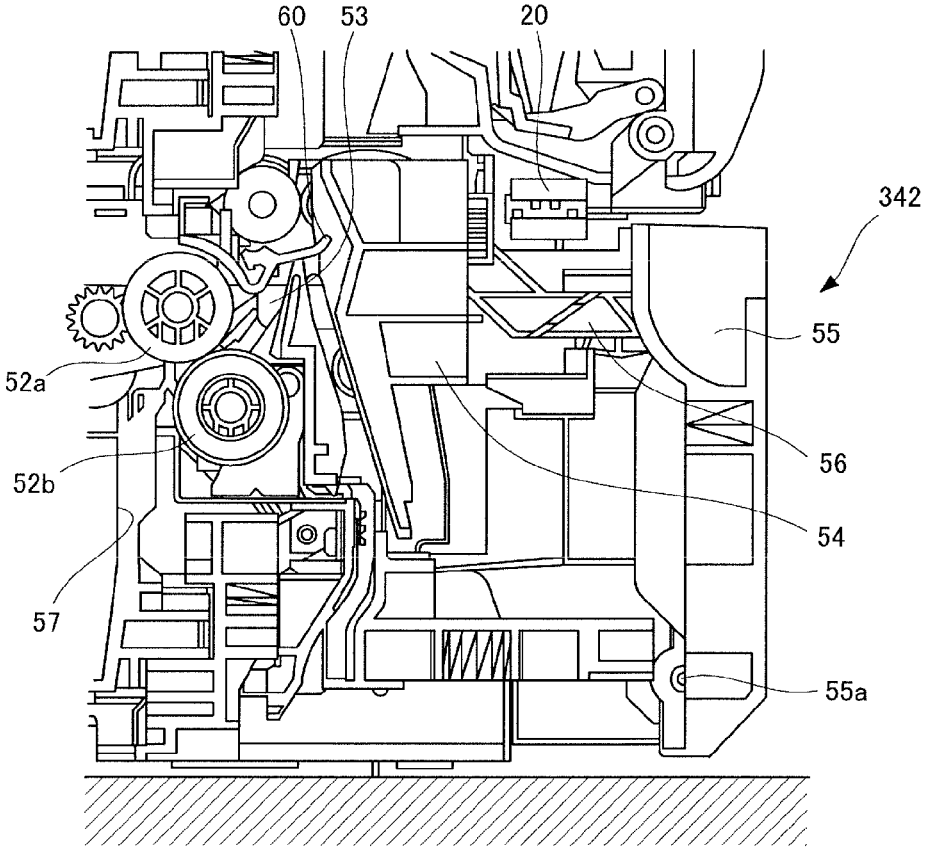
FIG. 4 is an enlarged view illustrating a main part in a state in which the option unit is added while a sound insulation member of the printer is attached.

As illustrated in FIG. 4, the option unit 342 includes a sheet cassette 57 and a pickup roller (not illustrated) that feeds the sheet stored in the sheet cassette 57. The option unit 342 also includes a conveying roller 52*a*, a separation roller 52*b*, a separation portion that separates one by one the sheet delivered from the pickup roller, and a sheet conveying path 53 that conveys the separated sheet to the sheet conveying apparatus 34.

When the controlling portion 51 issues an instruction to feed the sheet from the option unit 342, the sheet stored in the sheet cassette 57 is conveyed from the sheet conveying path 53 to the sheet conveying apparatus 34 by the pickup roller. Then the sheet is conveyed from the option unit 342 to the image forming portion by the sheet conveying apparatus 34.

A sheet detection flag 60 is provided in the sheet conveying path 53 to detect the sheet passing through the sheet conveying path 53. When passing through the sheet conveying path 53, the sheet presses the sheet detection flag 60 to turn the sheet detection flag 60. When the turning of the sheet detection flag 60 is detected, a sensor (not illustrated) outputs a signal to the controlling portion 51. Therefore, the controlling portion 51 detects the pass of the sheet.

In the option unit 342, a guide 54 provided on a front surface side of the sheet conveying path 53 is opened when the sheet conveying path 53 is jammed with the sheet. In the embodiment, a front door 55 that can be opened and closed with a horizontal shaft 55*a* as a supporting point is provided on a front surface of the option unit 342, and the guide 54 is coupled to the front door 55 by a coupling arm 56. When the jam recovery is performed in the sheet conveying path 53, the front door 55 is opened, and the guide 54 is opened through the coupling arm 56 interlocking the opening operation of the front door 55.

Figure 5:
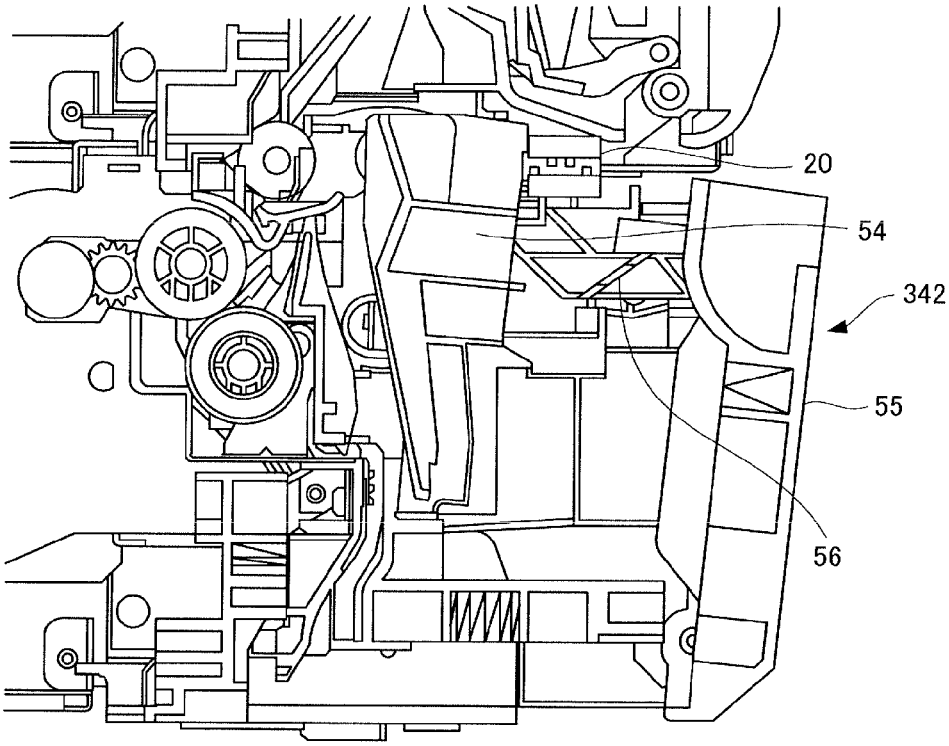
FIG. 5 is a view illustrating a state in which jam recovery of the option unit is performed while the sound insulation member is attached to the printer.

When the option unit 342 is added, when the option unit 342 is connected while the sound insulation member 20 is mounted as illustrated in FIG. 4, the guide 54 and the sound insulation member 20 interfere with each other as illustrated in FIG. 5 in opening the front door 55 for the purpose of the jam recovery. Therefore, the guide 54 cannot be opened.

In the embodiment, the sound insulation member 20 is detachably attached to the printer main body 2, and the sound insulation member 20 is detached from the bottom side of the printer main body 2 when the option unit 342 is added. The sound insulation member 20 is formed into a long shape in a front-back direction of the apparatus such that the noise in the printer 1 does not leak to the outside, and an operation portion (knob portion) on the front side is disposed so as to be exposed frontward when the sheet cassette 17 is drawn. In the embodiment, the sheet cassette 17 has a front loading system, namely, the sheet cassette 17 is provided so as to be able to be drawn (detachably attached) in a width direction orthogonal to a sheet conveying direction from the front surface of the printer main body 2 (option unit 342).

Figure 6A:
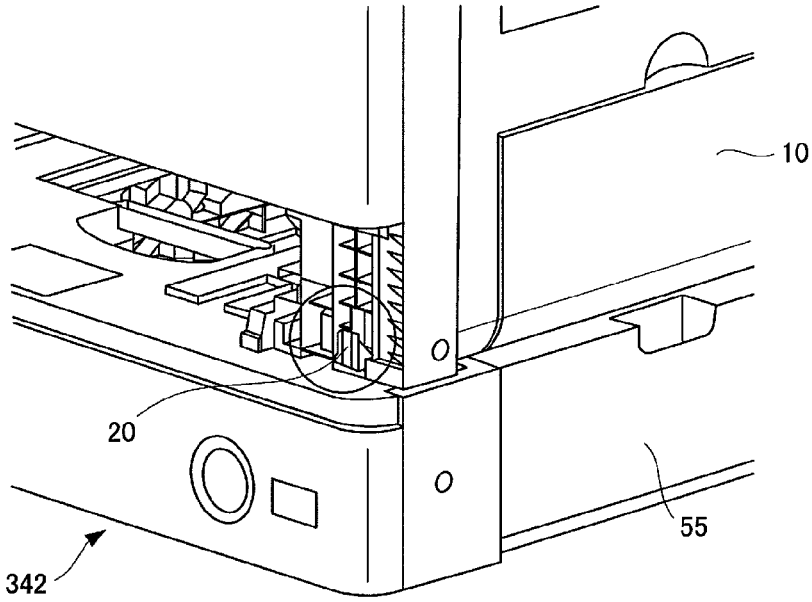
FIGS. 6A and 6B are views illustrating a state in which the sound insulation member is detached from the printer.
Figure 6B:
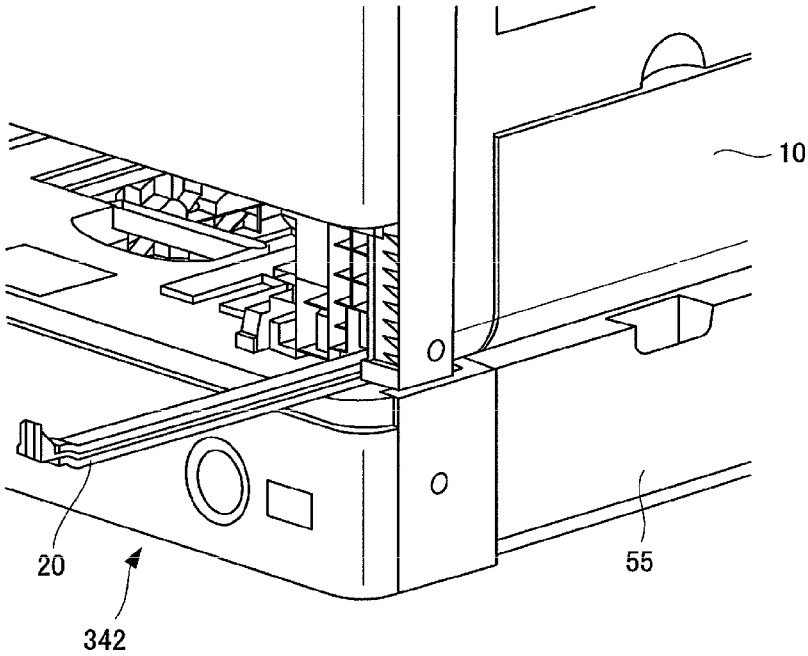
Figure 7:
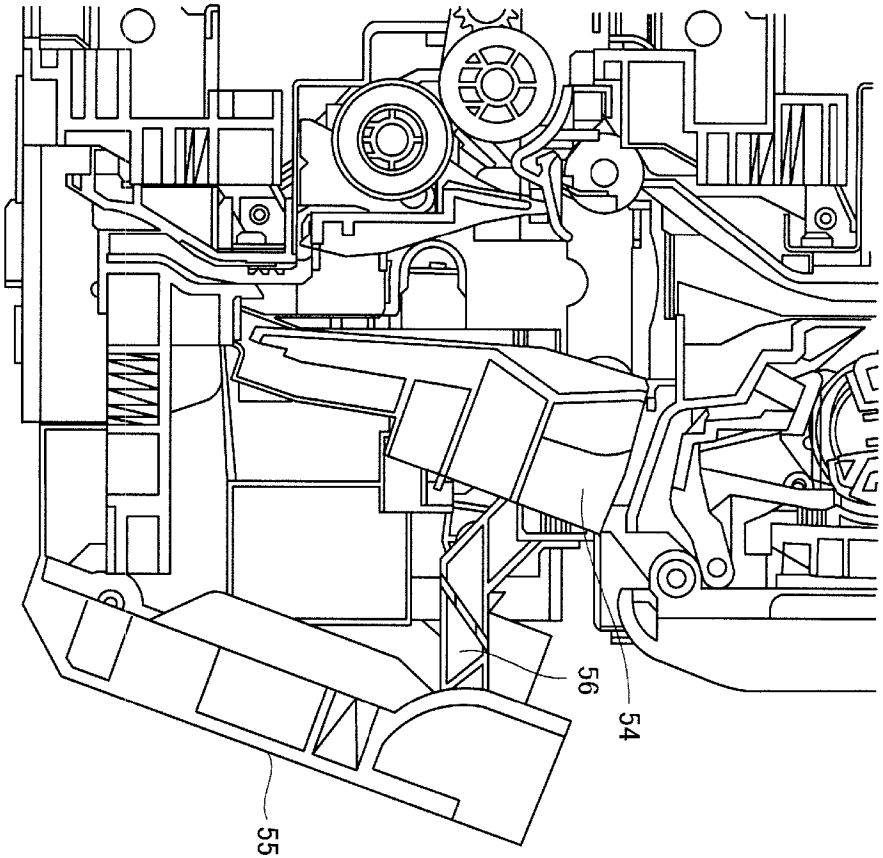
FIG. 7 is a view illustrating a state in which the jam recovery of the option unit is performed while the sound insulation member is detached from the printer.

When the option unit 342 is added, usually the option unit 342 is attached to the bottom side of the printer main body 2 after the sound insulation member 20 is detached from the bottom side of the printer main body 2. However, if that does not happen, after the sound insulation member 20 is exposed by drawing the sheet cassette 17 from the sheet conveying apparatus 34 as illustrated in FIG. 6A, the sound insulation member 20 can also be drawn as illustrated in FIG. 6B. Therefore, when a jam recovery is performed in the sheet conveying path 53, because the front door 55 thus can be opened without the sound insulation member 20, as illustrated in FIG. 7, the guide 54 can be opened through the coupling arm 56 interlocking the opening operation of the front door 55.

Figure 8:
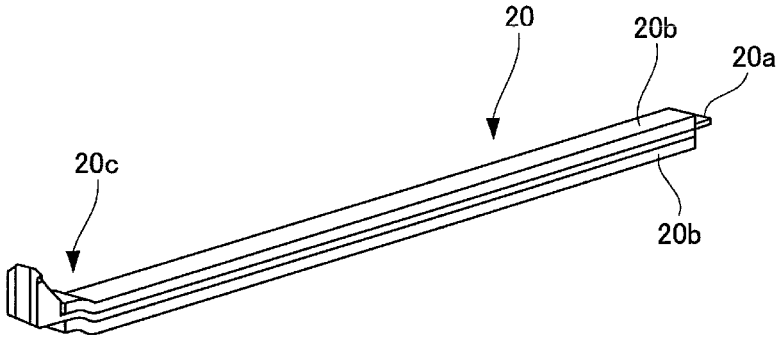
FIG. 8 is a perspective view of the sound insulation member.

As illustrated in FIG. 8, the sound insulation member 20 includes a core material 20*a* that is made of a resin or the like and elastic members 20*b* such as a sponge, which are bonded to an upper surface and a lower surface of the core material 20*a*. A step portion 20*c* is formed on the front surface side of the sound insulation member 20 to be latched in a latch portion (not illustrated) provided in the printer main body 2. In mounting the sound insulation member 20 on the printer main body 2, the step portion 20*c* is latched in the latch portion of the printer main body 2. Therefore, the sound insulation member 20 does not drop out from the printer main body 2 but the sound insulation member 20 can be mounted at the correct mounting position.

Figure 9:
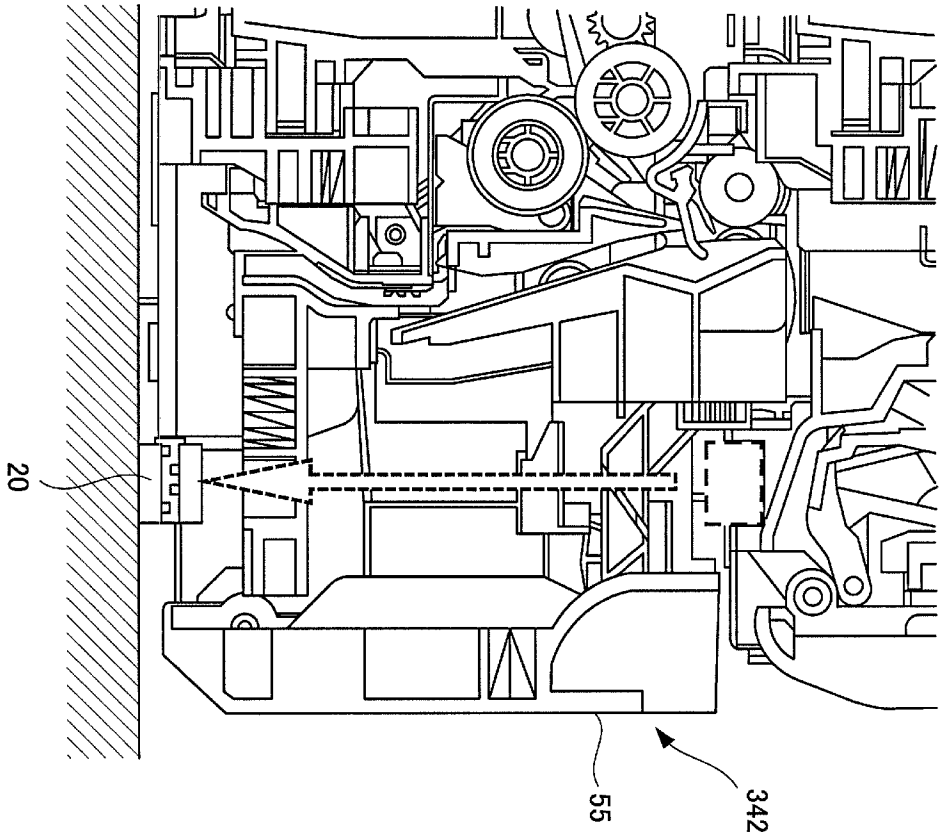
FIG. 9 is a view illustrating a state in which the sound insulation member is attached to the option unit after detached from the printer.

When the option unit 342 is added, as described above, after the sound insulation member 20 is detached, the sound insulation member 20 is attached to the bottom of the option unit 342 as illustrated in FIG. 9. Therefore, the gap between the option unit 342 and the mounting surface is closed by the sound insulation member 20 while the sound insulation member 20 is deformed between the option unit 342 and the mounting surface.

Figure 10:
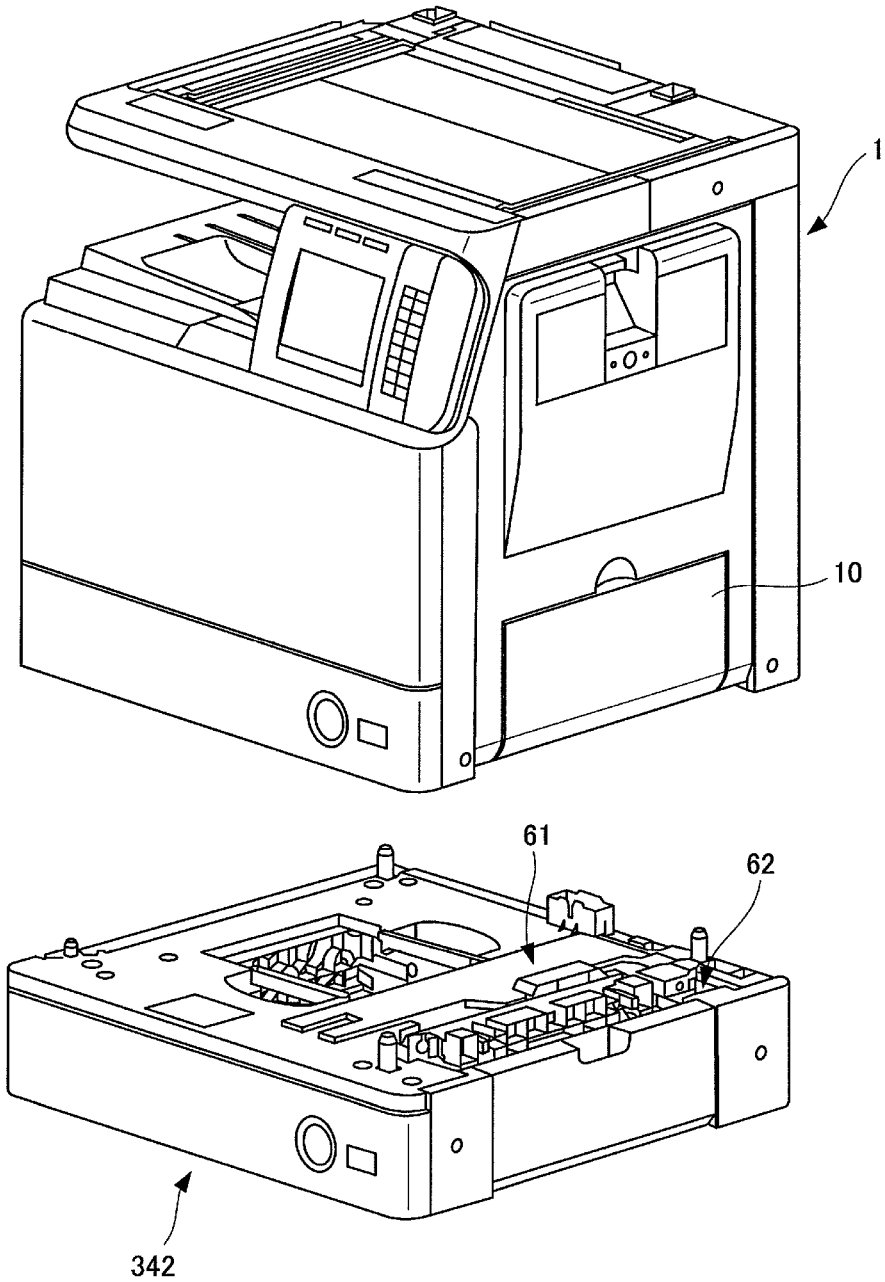
FIG. 10 is a perspective view illustrating a configuration of the option unit.
Figure 11:
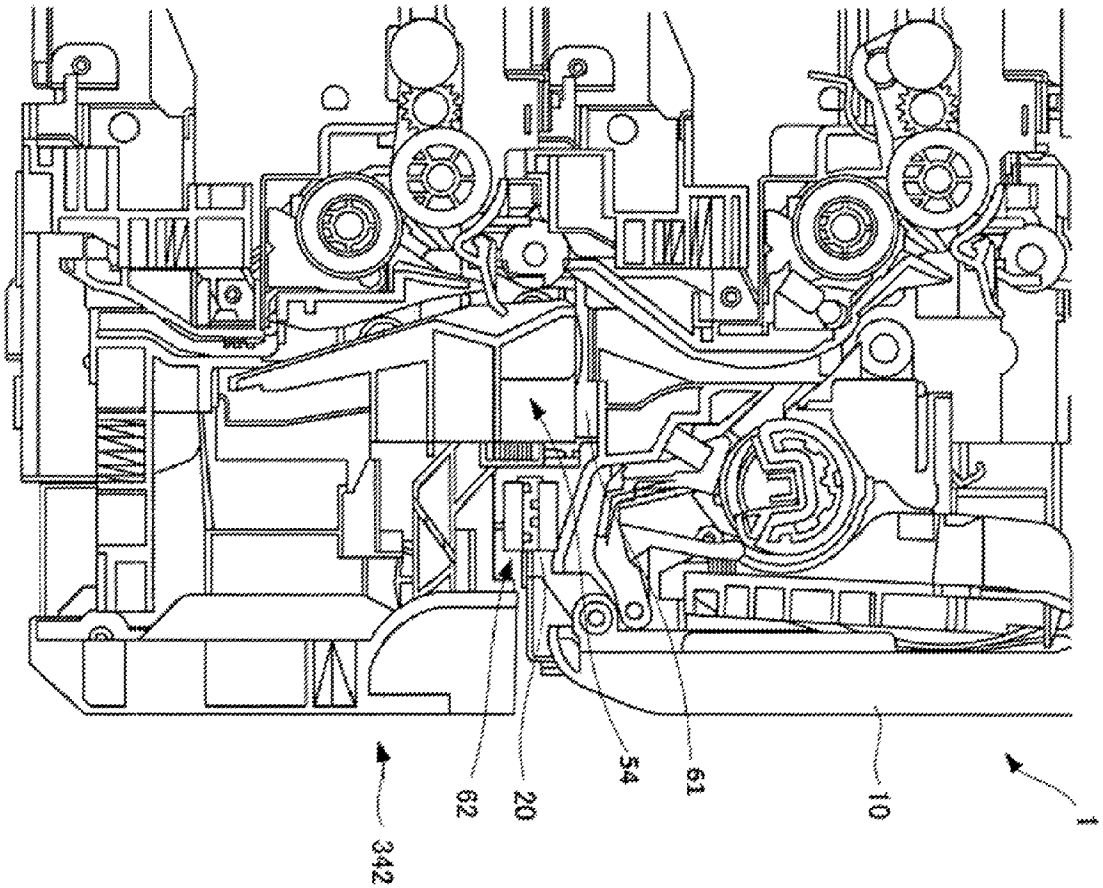
FIG. 11 is a view illustrating a state in which the option unit has been added while the sound insulation member is attached to the printer.

As illustrated in FIG. 10, an upper guide portion 61 constituting the sheet conveying path 53 is projected from an upper portion of the option unit 342. When the option unit 342 is added, the upper guide portion 61 that is a projection enters the bottom portion of the sheet feeding and conveying unit 341 of the printer main body 2 as illustrated in FIG. 11, thereby preventing the leakage of the noise.

As described above, it is necessary to detach the sound insulation member 20 when the option unit 342 is attached. Sometimes a user forgets to detach the sound insulation member 20, and the option unit 342 is added while the sound insulation member 20 is attached to the printer main body 2 as illustrated in FIG. 11. In such cases, a recess 62 illustrated in FIGS. 10 and 11 is formed on the upper surface of the option unit 342 such that the sound insulation member 20 is not damaged by nipping the sound insulation member 20 between the printer main body 2 and the option unit 342, whereby the sound insulation member 20 enters the recess 62. The formation of the recess 62 can prevent the breakage of the sound insulation member 20 even if the user forgets to detach the sound insulation member 20.

The sheet can be fed even if the user forgets to detach the sound insulation member 20. However, as described above, the jam recovery cannot be performed when the sheet jam is generated. At the time the jam recovery cannot be performed, the sound insulation member 20 is exposed by drawing the sheet cassette 17, and the operation portion (knob portion) is drawn. Therefore, the sound insulation member 20 can be detached without detaching the option unit 342 from the printer main body 2. Alternatively, a detection portion may detect the presence or absence of the sound insulation member 20 when the option unit 342 is added.

Figure 12:
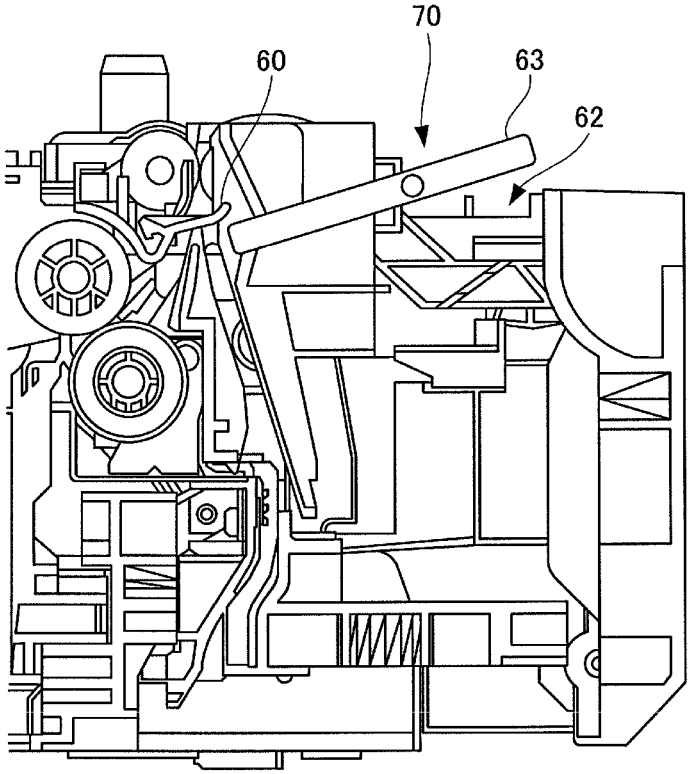
FIG. 12 is a view illustrating a configuration of a detects unit that detects the presence or absence of the sound insulation member.
Figure 13A:
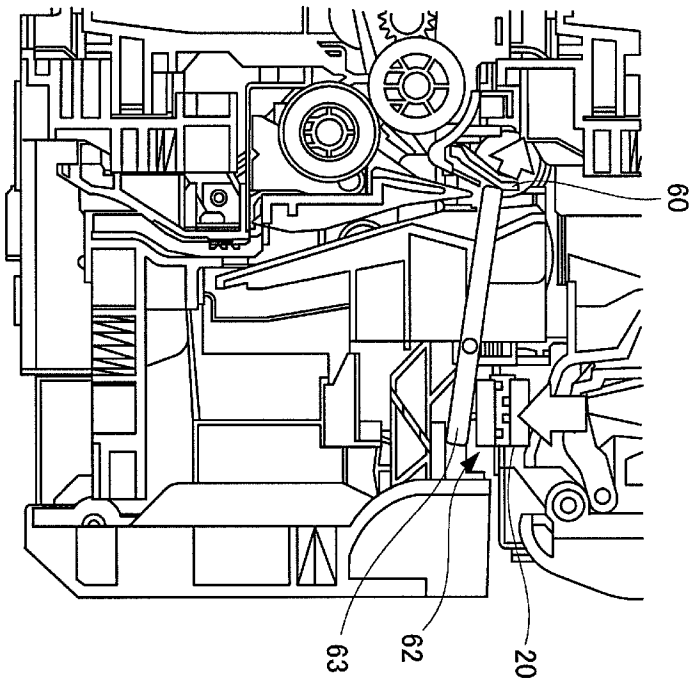
FIGS. 13A and 13B are views illustrating an operation of the detection unit.

A configuration of the detection portion that detects the presence or absence of the sound insulation member 20 will be described below. As illustrated in FIG. 12, a coupling lever 63 that is a moving member is provided in the option unit 342 while being able to swing (move). When the user forgets to detach the sound insulation member 20 in adding the option unit 342 to the printer main body 2, the coupling lever 63 abuts on the sound insulation member 20 to swing clockwise as illustrated in FIG. 13A.

At this point, when the coupling lever 63 swings, the coupling lever 63 turns the sheet detection flag 60, whereby the sensor (not illustrated) that is a signal output portion outputs the signal to the controlling portion 51. That is, in the embodiment, a detection portion 70 that detects the presence or absence of the sound insulation member 20 includes the coupling lever 63 and the sheet detection flag 60.

Figure 13B:
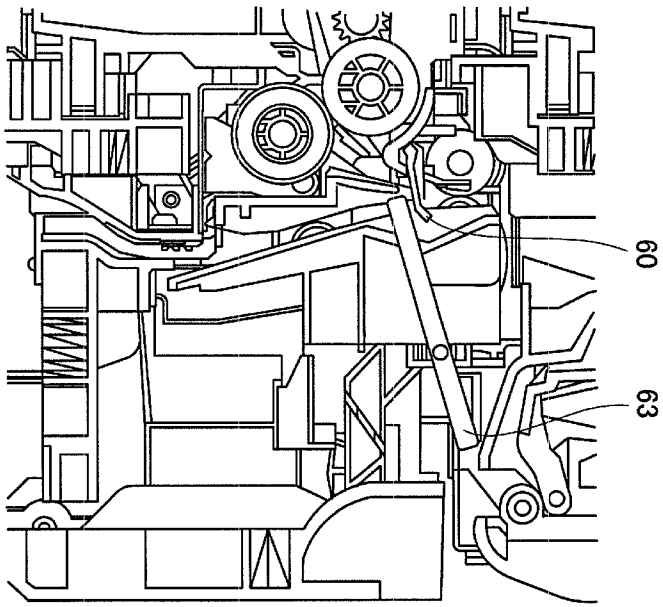

When the signal is input from the sensor in adding the option unit 342, the controlling portion 51 determines that the user forgets to detach the sound insulation member 20 and displays the detachment of the sound insulation member 20 on the operation portion (not illustrated). Then, when the exposed sound insulation member 20 is detached by drawing the sheet cassette 17, the coupling lever 63 swings counterclockwise by a self-weight as illustrated in FIG. 13B. Therefore, the sheet detection flag 60 returns to the position in which the sheet can be detected.

As described above, in the embodiment, the recess 62 is provided on the upper surface of the option unit 342, and the sound insulation member 20 enters the recess 62 when the option unit 342 is mounted while the sound insulation member 20 is not detached. Therefore, the sound insulation member 20 is not broken even if the user forgets to detach the sound insulation member 20. The sound insulation member 20 can easily be detached even if the option unit 342 is mounted on the printer main body 2.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-194764, filed Aug. 31, 2010, which is hereby incorporated by reference herein in its entirety.

What is claimed is:

1. An image forming apparatus comprising:

an image forming apparatus main body;

an option sheet feeding apparatus including a sheet cassette that stores sheets and a sheet feeding portion that feeds the sheets stored in the sheet cassette, that is added to a bottom of the image forming apparatus main body;

a sound insulation member that is provided between the image forming apparatus main body and a mounting surface on which the image forming apparatus is mounted and which is detachably attached to the bottom of the image forming apparatus main body so as to shield a noise in the image forming apparatus main body when the option sheet feeding apparatus is not added to the image forming apparatus, wherein the sound insulation member is an elongated member that extends substantially along a width of the image forming apparatus main body; and a recess that extends substantially along the width of the image forming apparatus main body and that is provided on an upper surface of the option sheet feeding apparatus so that the sound insulation member can enter the recess when the option sheet feeding apparatus is added to the image forming apparatus in state that the sound insulation member is not detached from the image forming apparatus main body.

2. The image forming apparatus according to claim 1, wherein a sheet cassette is detachably provided in the image forming apparatus main body, and the sound insulation member is detached while the sheet cassette is drawn.

3. The image forming apparatus according to claim 1, wherein the sound insulation member is attached on a bottom of the option sheet feeding apparatus in state that the option sheet feeding apparatus is added to the image forming apparatus main body.

4. The image forming apparatus according to claim 1, further comprising:

a detection portion that is provided in the option sheet feeding apparatus to detect presence or absence of the sound insulation member in adding the option sheet feeding apparatus.

5. The image forming apparatus according to claim 4, wherein the detection portion includes a moving member that abuts on the sound insulation member to move when the sound insulation member is not detached, and a signal output portion that outputs a signal indicating that the sound insulation member is not detached in association with the movement of the moving member.

6. The image forming apparatus according to claim 5, wherein the signal output portion is a sensor that detects pass of the sheet of the option sheet feeding apparatus.

7. The image forming apparatus according to claim 4, further comprising:

a controlling portion; and an operation portion;

wherein the controlling portion controls the operation portion so as to display a message that the sound insulation member remains on the image forming apparatus main body, based on a detection by the detection portion.

8. The image forming apparatus according to claim 1, wherein a projection is provided on the upper surface of the option sheet feeding apparatus so as to enter the bottom of the image forming apparatus main body to shield the noise in the image forming apparatus main body in adding the option sheet feeding apparatus.

9. An image forming apparatus comprising:

an image forming apparatus main body;

an option sheet feeding apparatus including a sheet cassette that stores sheets and a sheet feeding portion that feeds the sheets stored in the sheet cassette, that is added to a bottom of the image forming apparatus main body;

a sound insulation member that is provided between the image forming apparatus main body and a mounting surface on which the image forming apparatus is mounted and which is detachably attached to the bottom of the image forming apparatus main body so as to shield a noise in the image forming apparatus main body when the option sheet feeding apparatus is not added to the image forming apparatus;

a recess that is provided on an upper surface of the option sheet feeding apparatus, and which is positioned so that the sound insulation member can enter the recess when the option sheet feeding apparatus is added to the image forming apparatus; and a detection portion that is provided in the option sheet feeding apparatus to detect a presence or absence of the sound insulation member in adding the option sheet feeding apparatus.

10. The image forming apparatus according to claim 9, further comprising a controlling portion; and an operation portion;

wherein the controlling portion controls the operation portion so as to display a message that the sound insulation member remains on the image forming apparatus main body, based on a detection by the detection portion.

* * * * *